US005733236A

United States Patent [19]

De Smedt

[11] Patent Number: 5,733,236

[45] Date of Patent: Mar. 31, 1998

[54] BAG-MAKING APPARATUS HAVING AUTOMATED POSITIONING OF ATTACHMENTS

[75] Inventor: Eric De Smedt, Opwijk, Belgium

[73] Assignee: FMC Corporation, Philadelphia, Pa.

[21] Appl. No.: 770,758

[22] Filed: Dec. 19, 1996

[51] Int. Cl.[6] ..... B65H 43/08; B31B 1/00

[52] U.S. Cl. ..... 493/8; 493/11; 493/13; 493/17; 493/24; 493/193

[58] Field of Search ..... 493/193–197, 493/8, 10, 11, 13–15, 17, 18, 29, 24

[56] References Cited

U.S. PATENT DOCUMENTS 2,321,647 6/1943 Brougham ..... 493/11
3,545,447 12/1970 Corbett ..... 493/11

*Primary Examiner*—Jack W. Lavinder
*Attorney, Agent, or Firm*—Michael C. Penn

[57] ABSTRACT

A bag-making apparatus is configured for automatic positioning of a plurality of attachments of the apparatus which are in operative association with a web of bag-making material. The adjustment apparatus is configured to effect conjoint translational movement of the plurality of attachments along an attachment bed of the apparatus thus providing highly accurate and automated positioning of the attachments attendant to changes in print repeat length of the web. In the illustrated embodiment, the adjustment mechanism includes a pivotably mounted lever arm which extends generally along the length of the attachment bed, with a system of gear racks operatively interconnected with the lever arm for effecting conjoint translational movement of the attachments. Automatic controls of the arrangement effect automated adjustment during dwell or stop periods of bag making, and also facilitate reconfiguration of the apparatus for making bags of differing print repeat lengths.

19 Claims, 5 Drawing Sheets

BAG-MAKING APPARATUS HAVING AUTOMATED POSITIONING OF ATTACHMENTS

TECHNICAL FIELD

The present invention relates generally to a bag-making machine which handles a web of film material from which bags are made in end-to-end relationship, and more particularly to a bag-making apparatus having a plurality of movably positionable attachments thereon, with an arrangement provided for automatically proportionately positioning the attachments relative to each other for high-speed manufacture of bags.

BACKGROUND OF THE INVENTION

In a typical bag-making process, a substantially continuous web of film material, such as plastic or paper, is drawn through a bag-making apparatus so that the web is subjected to the series of processes necessary to convert the web into a plurality of bags arranged in end-to-end relationship. The bag-making machines of this type may be configured for intermittent operation, that is, for intermittent advancement of the web of film material as it is converted to a series of bags.

Operation of intermittent bag-making machines (i.e., wicketers, flat belt, bottom seal machinery, etc.) at high forming speeds and the desire to tolerate varying print repeat lengths on the web has resulted in efforts to improve operating efficiency and accuracy. In particular, it is desirable that various attachments of the machine, such as those for effecting wicket punching, handle cutout, etc., be positioned proportionately to each other in connection with altering the machine to accommodate a change in the print repeat length, as may result from tension changes in the attachment bed area of the machine or from variations in the printing process and the subsequent rewinding of the film web. When running printed bag material in registration, a photoeye of the machine tracks the registration (print) mark provided on each of the bags being made. Through the automatic controls of the machine, draw length is adjusted in such a way that the registration mark stays in registry with the photoeye. Because the various bag-making processes are referenced with respect to this photoeye, the photoeye is sometimes considered to be the only "fixed" point of the process, that is, fixed in relation to the registration mark (but not necessarily fixed in relation to the attachment rail of the apparatus).

If the print repeat length changes, i.e., because of the aforementioned tension changes or printing variations, all attachments on the attachment area (both upstream and downstream from the photoeye) need to be repositioned to anticipate the varying print repeat, or some other arrangement provided to accumulate the web material so that it is properly positioned beneath the attachment(s). While previous arrangements are known to facilitate such repositioning, such arrangements have not provided the degree of accuracy and/or versatility which is desired to facilitate high-speed machine operation.

By way of example, it has been known to effect simultaneous repositioning of several attachments which are mechanically fixed to each other, or which are collectively mounted on a common mount. In such "combined mount" arrangements, repositioning for accommodating changeover of the machine results in only one attachment being exactly correctly positioned, typically the attachment which is closest to the auto-correction scanner of the adjusting system. The other attachments, of course, are each repositioned with an error which becomes larger depending upon how far away each attachment is from that attachment which had been exactly correctly positioned.

One such auto-correction arrangement for bag-making attachments entailing use of a "combined mount" has included a motor-driven gear thereon. The gear is in meshing engagement with a gear rack which extends along an attachment bed of the machine, whereby operation of the motor effects upstream and downstream movement of the combined mount. In this arrangement, two photoeyes are mounted on one of the attachments, with the photoeyes offset (such as by 3 mm.) in the direction of the film web. Signals from these photoeyes are directed to a programmable logic controller, which in turn operates the adjusting motor. The "combined mount" and the photoeyes are positioned in such a way that in normal running conditions one photoeye is on the registration mark, and the other photoeye is next to the registration mark. During web stop or dwell (i.e., during sealing and for a brief time period before and after), the auto-correction system is armed or activated. Depending upon the relative positioning of the mount, and the relationship of the photoeyes to the registration mark, the auto-correction system will either move the mount upstream or downstream, or effect no movement. While this arrangement facilitates automatic correction of the attachments, this arrangement has the disadvantages of having a 3 mm. dead gap (wherein no proportional adjustment is effected), and still suffers from the deficiency that only one of the attachments is exactly correctly positioned. The other attachments on the "combined mount" will have an error proportional to their distance from the exactly correctly positioned one of the attachments.

In another previously known adjustment arrangement, a three-roller vertical S-wrap is positioned on the attachment bed of the bag-making machine. For example, this three-roll arrangement can be mounted immediately upstream from the so-called centerfold gusset former. In this arrangement, the middle S-wrap roller can move up and down by means of an electric motor. The auto-correction arrangement includes an analog photoeye mounted on the machine frame or attachment rail upstream of the S-wrap rollers. The signal from this photoeye is fed into a guiding system, which drives the motor on the middle S-wrap roller. During web stop (again, during sealing and for a time period before and after), the auto-correction system is activated. The S-wrap roller is positioned in such a way that in normal running conditions, the photoeye is on one edge of the registration mark. Depending upon the signal generated by the photoeye, the S-wrap roller is moved up or down, to accumulate or release web material, until the photoeye mark is back on the edge of the registration mark. However, like other adjusting arrangements, this system suffers from the disadvantage that only one attachment is exactly correctly positioned, while other attachments of the bag-making machine will be positioned with an error which is proportional to their distance from the exactly correctly positioned attachment.

In yet another previously known adjustment arrangement, a "combined mount" having a plurality of attachments thereon, is movably positioned on the attachment bed of the machine. A motor-driven gear is provided on the combined mount, with the gear in meshing engagement with a gear rack extending along the attachment bed. Operation of the motor effects movement of the combined mount upstream or downstream of the attachment bed. On one of the attachments of the mount, an analog photoeye is mounted. The signal of this photoeye is fed into a guiding system, which drives the motor on the combined mount. The combined mount (and the photoeye thereon) are positioned in such a way that in normal running conditions, the photoeye is on one edge of the registration mark. During film stop (during sealing, and for a time period before and after) the auto-correction system is activated. Depending upon the photoeye signals, the auto-correction arrangement will move the combined mount upstream, downstream, or not at all. As in previously-described systems, this arrangement results only in one of the attachments on the mount being exactly correctly positioned. Again, other attachments on the combined mount will be positioned with an error proportional to their distance from the exactly correctly positioned attachment.

The present invention is directed to a bag-making apparatus having an automated adjustment system for effecting correct relative positioning of bag-making attachments to facilitate correct positioning of various attachments attendant to changes in the print repeat length, thus facilitating accurate high-speed operation while achieving smaller variations in the resultant bags.

SUMMARY OF THE INVENTION

A bag-making apparatus embodying the principles of the present invention is illustrated as an intermittent bag-making machine which can be configured for various types of sealing (i.e., bottom seal, mixed seal, side weld, etc.), and can be configured to permit bags to be "picked off" by any of various known techniques (i.e., wicket, on-the-roll, needle stacking, flat belt stacking, etc.). The apparatus includes an attachment bed which defines a web flow path along which a web of bag-making material is moved. A web draw drive mechanism is provided for drawing the web of bag-making material along the attachment bed.

In accordance with the present invention, the apparatus includes a plurality of bag-making attachments which are movably mounted on the attachment bed along the web flow path. In order to facilitate adjustments in the draw length of the web, the present apparatus includes an auto-correction arrangement by which the various attachments of the machine are proportionately positioned relative to each other as they are automatically positioned along the web flow path of the apparatus. This provides desirably accurate relative positioning of the attachments, thus facilitating high-speed operation of the machine, while accommodating print repeat length changes resulting from tension changes, or printing variations. While it is contemplated that such adjustment be effected during the stop or dwell period of the web, it is within the purview of the present invention to effect adjustment during drawing of the web following measurement of the error during the web stops or dwell prior to drawing of the web.

In accordance with the illustrated embodiment, the apparatus includes an automated adjustment arrangement for adjustably positioning a plurality of bag-making attachments along the attachment bed of the apparatus. The adjustment arrangement is configured to effect conjoint, translational movement of the attachments on the attachment bed along the web flow path while positioning the attachments proportionately to each other. While it is contemplated that the adjustment arrangement may be provided in the form of servo drive motors or the like respectively mounted on the attachments of the apparatus, the illustrated embodiment includes a desirably straightforward drive mechanism for effecting conjoint translational movement of the attachments. It is to be understood, however, that it is within the purview of the present invention to provide an arrangement for effecting proportional relative positioning of the attachments by other than the specifically illustrated drive mechanism.

In particular, the drive includes at least one pivotally mounted lever which extends generally along the web flow path, preferably beside the attachments of the apparatus, for operative connection with each of the attachments. The drive mechanism of the adjustment arrangement includes an actuator connected to the pivotally mounted lever for pivoting the lever about a fulcrum, thus effecting the driven conjoint movement of the attachments on the attachment bed. To this end, the drive mechanism includes a plurality of gear racks respectively mounted on the attachments, with each of the gear racks in operative engagement with the pivotally mounted lever so that pivotal movement of the lever by the associated actuator translates each gear rack proportionately to the spacing of the gear rack from the fulcrum of the lever. In the preferred form, the drive mechanism further includes a gear drive on each of the attachments for effecting translational movement thereof on the attachment bed along the web flow path. The gear drive of each attachment is in driven engagement with the respective one of the gear racks, and in turn is in meshing engagement with an elongated gear rack which extends along the length of the attachment bed.

The adjustment arrangement of the present invention includes a scanner positioned on one of the attachments, or on a separate mount, for generating a signal corresponding to the relative position of a registration mark, during web stop, provided on each bag being made. The adjustment mechanism further includes automated controls operatively connecting the scanner to the actuator which effects pivotal movement of the lever of the system. By this arrangement, operation of the actuator is effected responsively to the signal generated by the scanner.

In a first illustrated embodiment, the present apparatus includes a photoeye fixedly positionable relative to the attachment bed (such as in a fixed position of the attachment bed, or on the frame of the apparatus) for generating a signal in response to a registration mark provided on each of the bags being made. When running printed material in registration, the photoeye tracks the registration mark on each bag being made, with the controls of the apparatus adjusting the draw length such that the mark stays in registration with the photoeye. The pivotally mounted lever of the adjustment arrangement has a fulcrum fixed relative to the photoeye, with the movable attachments of the apparatus thus being moved relative to the photoeye. In an alternate embodiment, the fulcrum of the pivotally mounted lever is mounted in fixed relation to, and in vertical alignment with, a sealing mechanism of the apparatus. In this alternate embodiment, the photoeye which senses the registration marks on the bags being made is mounted on a movable attachment of the system, and is thus proportionately positionable, together with the remaining attachments, relative to the fulcrum aligned with the sealing mechanism of the apparatus.

Other features and advantages of the present invention will become readily apparent from the following detailed description, the accompanying drawings, and the appended claims.

DETAILED DESCRIPTION

Figure 1:
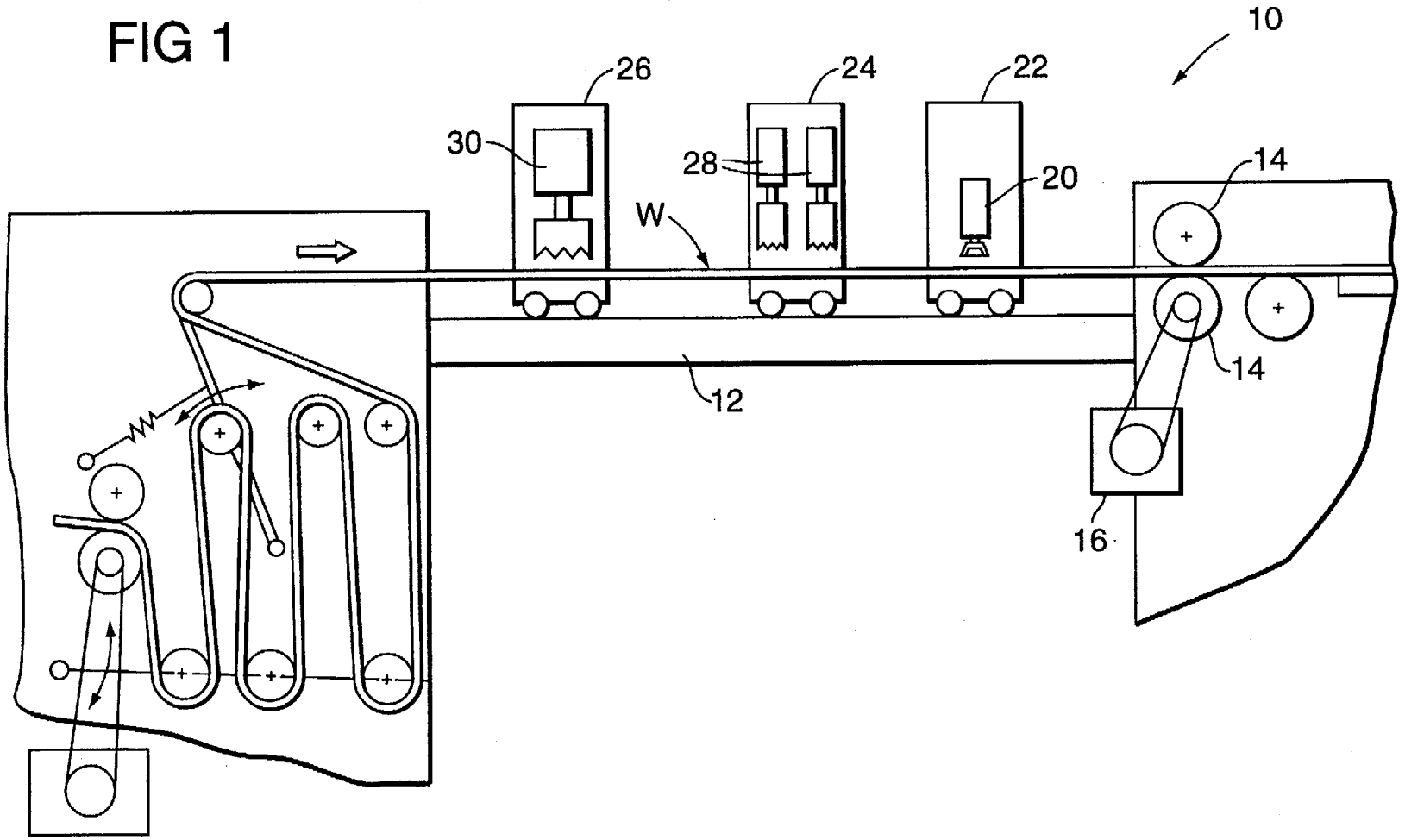
FIG. 1 is a diagrammatic view of an intermittently-operated bag-making apparatus of the type which can be configured to embody the principles of the present invention.
Figure 2:
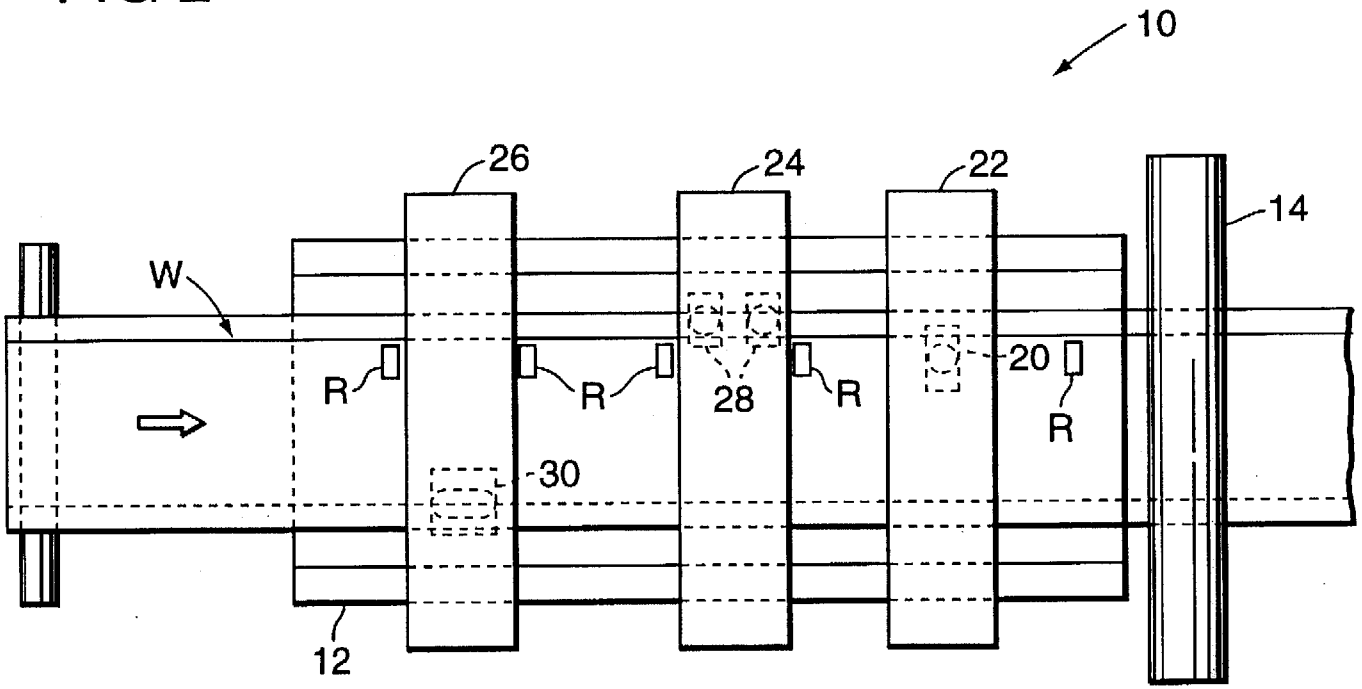
FIG. 2 is a diagrammatic top plan view of the bag-making apparatus shown in FIG. 1.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

The present invention is directed to a bag-making apparatus, designated 10, which is configured for intermittent operation as a web W of bag making material is drawn through the apparatus to make a series of bags in end-to-end relationship. As will be described, the bag-making apparatus 10 includes a plurality of attachments which are positioned in respective operative association with the web W for effecting various manufacturing processes on the bags being made. The present invention contemplates that the apparatus 10 includes an auto-correction positioning system for automatically adjusting the relative positions of the attachments attendant to changes in the print repeat length of the web of bag-making material which can result from tension changes or printing variations, thus facilitating accurate high-speed operation.

With reference to FIG. 1, bag-making apparatus 10 includes a generally elongated attachment bed 12 which defines a web flow path along which the web W of bag-making material is moved. A web draw drive mechanism, illustrated in the form of a pair of cooperating draw rollers 14, and an associated servo motor 16, effects intermittent drawing of the web along the attachment bed 12. Suitable dancer rolls and the like effect the desired tension and control of the web as it is intermittently drawn by the drive mechanism.

A plurality of bag-making attachments are movably mounted on the attachment bed 12 along the web flow path. As noted, each of these attachments is positioned for respective association with bags being made, and thus can take various forms. In the illustrated embodiment, a photoeye 20 is mounted on an attachment 22, which attachment may be "fixed" with respect to the attachment bed, thus providing the desired reference point with respect to which the other attachments are positioned. In an alternate embodiment, the attachment carrying the photoeye 20 can also be automatically adjustably positioned. When running printed material in registration, the photoeye tracks the registration (print) marks on the bags being made, with the automatic controls of apparatus 10 adjusting the draw length effected by rollers 14 such that the mark stays in phase with the photoeye.

Figure 4:
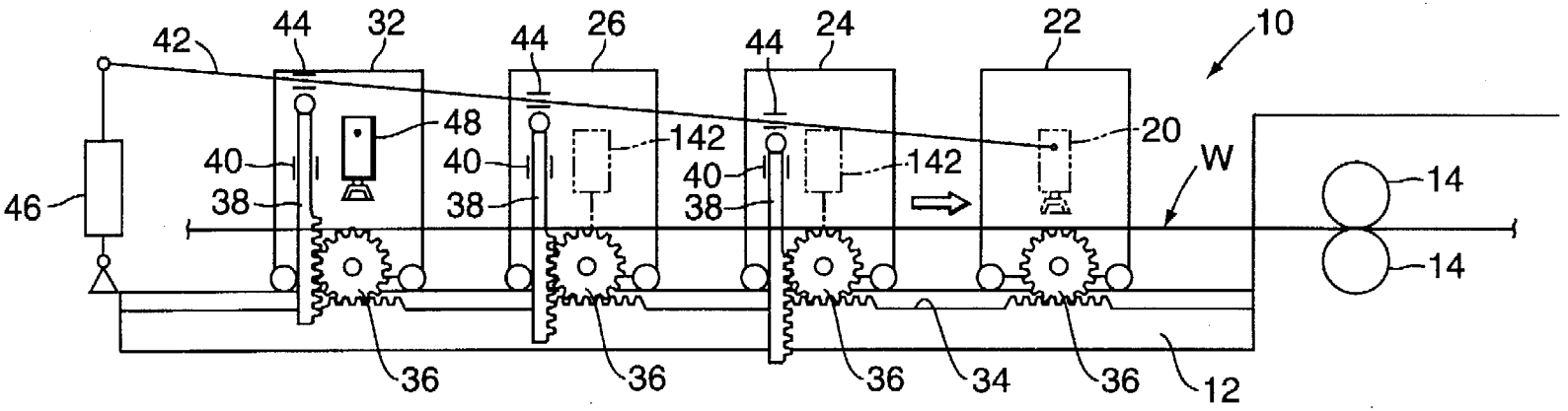
FIG. 4 is a diagrammatic view similar to FIG. 1 illustrating an automated attachment adjustment arrangement embodying the principles of the present invention.

Movably mounted attachments 24 and 26 are further illustrated, and may be configured to include the necessary devices for effecting various bag-making processes, such as the provision of wicket punches 28, and handle cutout unit 30. Each of the attachments is preferably provided with suitable wheels, skates, skids, or the like to allow rolling or sliding movement of each attachment along one or more attachment rails of the associated attachment bed 12. An additional attachment 32 (see FIG. 4) can be provided to carry a scanner of the present automated attachment positioning system, as will be described, or the scanner can be mounted on one of the attachments such as 24, 26.

The desired conjoint translational movement of the attachments with respect to the attachment bed is effected by providing the adjustment arrangement of the present invention with a drive mechanism which effects driven movement of the attachments along the attachment bed. The drive mechanism includes at least one elongated gear rack 34 mounted on the attachment bed 12, with each of the attachments of the apparatus including a drive gear 36 in respective meshing engagement with the gear rack 34. It is preferred that a pair of gear racks 34 be provided on respective sides of the apparatus, with each attachment including a pair of drive gears 36 in respective engagement with the pair of gear racks. While it is preferred that each of the gears is provided with the same pitch diameter, it is within the purview of the present invention that the pitch diameter of the gears may be slightly different.

The drive mechanism of the present auto-correction adjustment system further includes a plurality of vertically mounted gear racks 38 which are respectively mounted on each of the attachments. Each of the attachments is provided with a slide 40 for accommodating the sliding vertical movement of the respective one of the gear racks 38. In accordance with the illustrated embodiment, each of the gear racks 38 is in meshing engagement with the respective one of the drive gears 36, whereby vertical movement of each gear rack 38 effects translation of the attachment along the attachment bed by rotation of the respective gears 36, and driven movement thereby along the elongated gear rack 34. As will be recognized, the present invention can be configured such that each of the attachments includes two or more gears commonly mounted on a shaft, with one gear engaging gear rack 38, and the other gear engaging the gear rack 34. In other words, it is not necessary that the same gear 36 be in engagement with both the gear rack 38 and gear rack 34, although such an arrangement is presently preferred for simplicity and accurate positioning of the attachments.

As will be appreciated, proportional adjustment of the attachments of the present apparatus can be effected mechanically by other than the illustrated gears and gear racks. For example, a set of suitable linear cams can be provided on the one or more pivotable lever arms of the illustrated drive mechanism.

In order to effect the desired driven movement of the attachments along the attachment bed, the present adjustment system includes a pivotably mounted lever arm 42 which extends generally along the web flow path for operative connection with each of the attachments. The lever arm 42 is pivotal about a fulcrum thereof by operation of a suitable linear actuator 46 operatively connected with a free end of the lever (opposite its fulcrumed end). As will be appreciated, operation of the actuator 46 effects pivoting of the lever about its fulcrum, thereby effecting conjoint movement of gear racks 38, and thus conjoint movement of attachments 24, 26, and 32. Each of the gear racks 38 is linked to the lever arm 42 by a respective sliding pivot 44 which allows rotation of the gear rack with respect to the lever arm, while allowing linear displacement of the gear racks along the lever arm.

Operation of the actuator 46 is effected by the provision of a scanner 48, mounted on one of the attachments (attachment 32 in the illustrated embodiment). By way of example, the scanner 48 may be provided with an 8 mm. wide scanning width. It is within the purview of the present invention that the scanner 48 can be positioned upstream or downstream with respect to the fulcrum of the lever arm 42.

Figure 5:
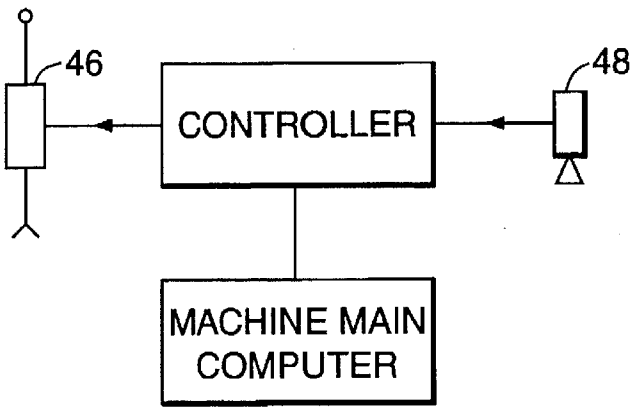
FIG. 5 is a diagrammatic view of a control system of the present invention.

The positioning of scanner 48 on one of the attachments of the apparatus is necessary to have attachment's function (handle cutout for example) on the correct position in the bag, and the scanner positioned on a registration or print mark. The signal generated by scanner 48 is fed to a controller of the system (FIG. 5) which is operatively connected with the linear actuator 46, and acts to drive the actuator. The actuator is connected to the frame of the apparatus, or to the attachment bed 12, on one end thereof, and to the lever arm 42 on the other end thereof. Only during web stop or dwell (sealing plus some time before and sometime after) is the controller of the system armed or activated. This information is given by the main computer of the apparatus (FIG. 5). During this time interval, or during the subsequent web draw, the controller can move the actuator, depending upon the input it gets from the scanner 48 of the system. For example, if the scanner is downstream of the print mark, the actuator 22 will retract. This will rotate the lever arm 42 counterclockwise. The movement of the lever arm will generate a downward movement of the gear racks 38. This downward movement of the gear racks, in turn, will generate a counterclockwise movement of gears 36. As a result, the attachments (including scanner 48), will move upstream. This translational movement or displacement will continue until the scanner is on the registration mark again (if it gets there before the end of the web stop window). Because of the lever action each attachment between, or even further upstream if applicable, of scanner 48, and the fulcrum of the lever 42 will be correctly proportionately positioned.

Figure 3A:
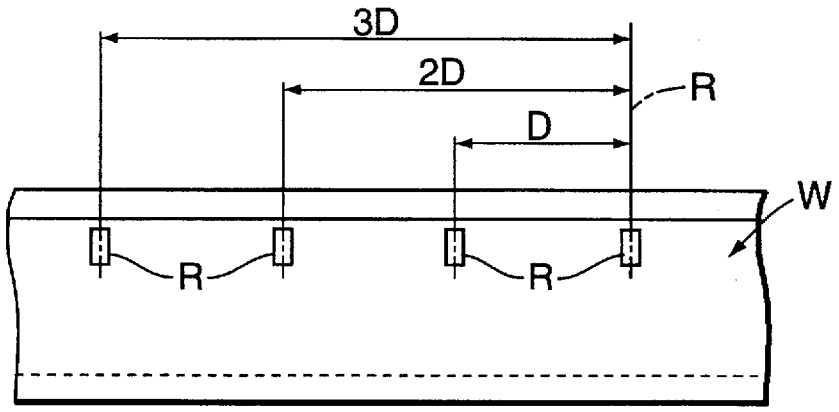
FIGS. 3A and 3B are diagrammatic views illustration registration (print) marks provided on a web of bag-making material, and illustrating changes in the print length of the bags being formed.
Figure 3B:
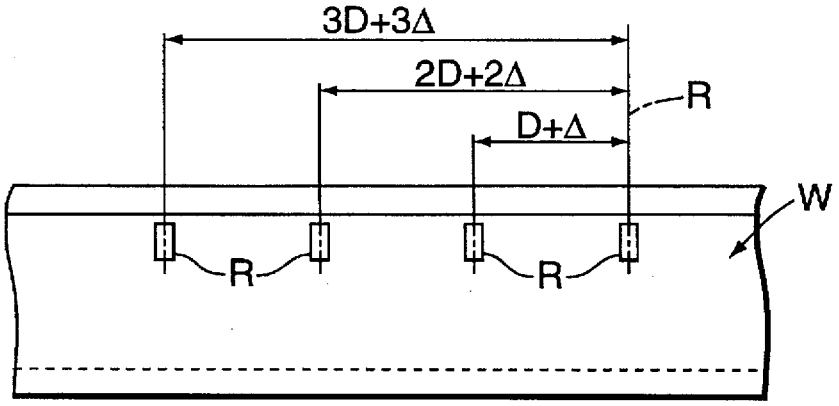

FIGS. 3A and 3B illustrate the web of bag-making material, and the registration (or print) marks R provided therealong. The registration marks can, of course, be part of the print design on each bag. FIG. 3A shows the web W and several of the registration marks R, with this illustration also showing the distance D between each print mark (corresponding to the print repeat length of each bag being formed). In contrast, FIG. 3B illustrates where the print repeat length D has changed to D plus Δ. This print repeat change can result from tension changes in the attachment bed area, or from printing variations. The dashed reference line R in FIGS. 3A and 3B is a reference line illustrating where the registration photoeye 20 of the apparatus is positioned, and provides in this first embodiment the only "fixed" point in the attachment area. In FIG. 3A, the upstream or downstream distance between two registration marks R changes by the dimension D, while in FIG. 3B, the upstream or downstream distance between two marks changes with D plus Δ. An attachment of the apparatus working on a bag which is one registration mark upstream needs a correction of Δ. An attachment working on two bags upstream needs a proportional adjustment or correction of 2Δ, etc.

Referring again to FIG. 4, the action of the lever 42 provides proportional correction of the various attachments of the bag-making apparatus. Because of the lever action, each attachment between (or even further upstream, if applicable) of the attachment carrying scanner 48 and the fulcrum of the lever will get a proportional correction, depending on its relative position along the length of the lever. By way of example, if an attachment of the apparatus is positioned at two times D from the fulcrum of the lever 42, and the scanner 48 is positioned at seven times D from the fulcrum, the aforementioned attachment will only receive a correction of two-sevenths of the adjustment effected upon the attachment carrying the scanner.

Figure 6:
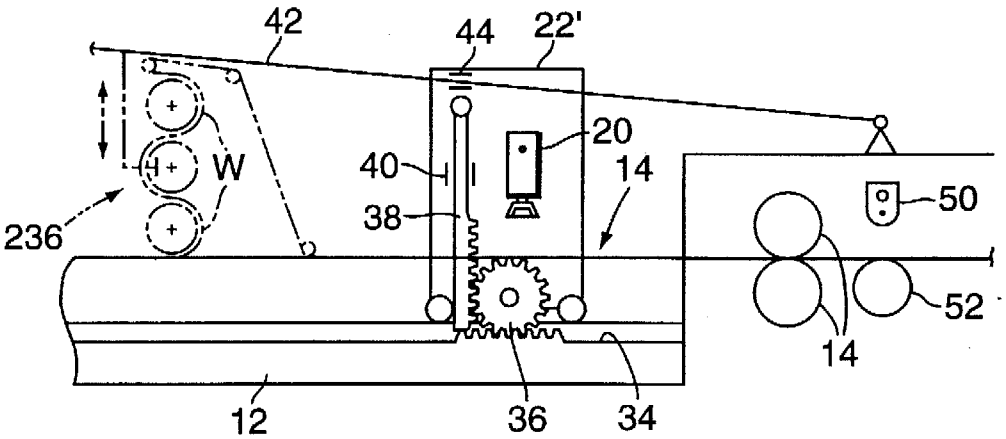
FIG. 6 is a diagrammatic view illustrating an alternate embodiment of the present invention.

A variation of the present invention is illustrated in FIG. 6, wherein the photoeye 20 of the system is mounted on its own moveable attachment 22', which attachment 22' is proportionately translated together with the other attachments of the auto-correction system. In this variation, the photoeye 20 may be mounted on one of the other attachments of the apparatus, rather than on its own attachment, as illustrated for clarity. In this arrangement, the fulcrum of lever arm 42 is positioned in vertical alignment and fixed with respect to a sealing mechanism of the bag-making apparatus. An exemplary sealing mechanism is illustrated in FIG. 6, as including seal bar 50 and seal bar 52. As is illustrated, the fulcrum of the lever arm is approximately in the vertical center of the sealing mechanism. By this arrangement, the photoeye attachment 22' is connected to the automated adjustment system, and will receive a proportional amount of correction, depending upon its location along the lever arm 42 and the attachment bed 12.

As noted, it is within the purview of the present invention that movement of the attachments of the present apparatus may be by other than the illustrated drive. For example, each movable attachment can be provided with a servo drive motor, such as illustrated at 142 in FIG. 4 in connection with attachments 24, 26. Each servo motor can be configured to drive an associated one of the drive gears 36, or arranged to otherwise effect movement of the attachment along the attachment bed, with operation of the servo motors effected by the automatic controls of the auto-correction system.

While the previously described configurations of the present invention effect the desired relative proportional positioning of the bagmaking attachment and the associated web of material by effecting movement of the attachments, it is possible to maintain the attachments in relatively fixed positions, and proportionately accumulate web material between the attachments to achieve the desired relative positioning. In such an alternate arrangement, a number of three-roll S-wrap mechanisms, such as illustrated in phantom line at 236 in FIG. 6, can be in association with fixedly positioned attachments. One of the S-wrap mechanisms can be provided between each pair of the attachments for which relative adjustment in the position of the attachments and the bag web is desired. In such an arrangement, a pivotable lever arm such as 42 can then be employed to move the middle roller of each S-wrap vertically up and down to accumulate or release web. While this arrangement can achieve the desired degree of accuracy, the inertia of the plural rolls such a system entails can impact upon its application in the present type of intermittent motion bag-making apparatus.

Figure 7:
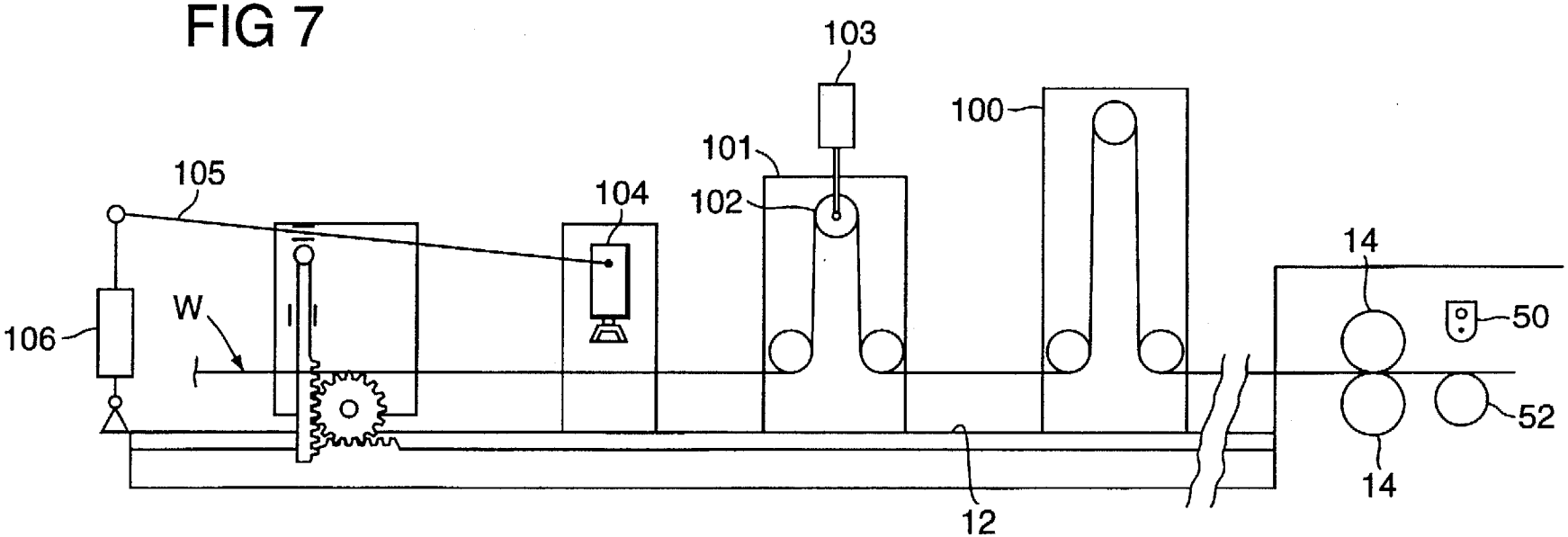
FIG. 7 is a diagrammatic view illustrating a modified embodiment of the present invention.

A modified embodiment of the auto-correction system of the present invention is illustrated in FIG. 7. The system is illustrated in association with a movable, vertical three-roller S-wrap 100 positioned on attachment rail 12. This type of arrangement, for example, involves a center-fold gusset-former. In such an arrangement, use of the present auto-correction system in the form previously described would result in attachments positioned upstream of the S-wrap 100 being incorrectly positioned because of the web accumulated in the S-wrap 100.

FIG. 7 illustrates a modified embodiment of the present invention to overcome the above problem. A three-roller S-wrap 101 is positioned further upstream of the S-wrap 100. The top roller 102 of the S-wrap can be moved, preferably up and down (i.e., vertically) by means of a linear actuator 103. Further upstream, a scanner 104 registers the print or registration mark R on the web W during web stop or dwell. Depending upon the information obtained by the scanner 104, the top roller 102 is moved up or down in order to phase the registration mark to the scanner.

If a second auto-correction system as described hereinabove is used (including lever arm 105, scanner 104, and an actuator 106 for moving the lever arm in response to signals from the scanner 104), with the fulcrum of the lever arm approximately in vertical alignment with scanner 104, all attachments further upstream of S-wrap 100 will be positioned correctly.

While the present disclosure contemplates that the relative position of the bag-making attachments and the associated web of material be as nearly proportional as is practicable for the highest possible accuracy, it is to be understood that a system embodying the present invention may effect relative positioning which is substantially proportional, by which may vary by a small degree from true proportional positioning.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A bag-making apparatus, comprising:

an attachment bed defining a web flow path along which a web of bag-making material is moved;

a web draw drive mechanism for drawing said web along said attachment bed;

a plurality of bag-making attachments movably mounted on said attachment bed along said web flow path for respective operative association with bags being made; and adjustment means for adjustably positioning said attachments along said attachment bed, said adjustment means being configured to effect conjoint translational movement of said attachments on said attachment bed along said web flow path while positioning said attachments proportionately to each other.

2. A bag-making apparatus in accordance with claim 1, wherein said adjustment means comprises at least one pivotably mounted lever extending generally along said web flow path for operative connection with each of said attachments, said adjustment means further including actuator means for pivoting said lever about a fulcrum to thereby effect driven conjoint movement of said attachment's on said attachment bed.

3. A bag-making apparatus in accordance with claim 2, wherein said adjustment means further includes a plurality of gear racks respectively mounted on said attachments each in operative engagement with said pivotably mounted lever so that pivotal movement of said lever by said actuator means translated each of said gear racks proportionately to the spacing of each gear rack from a fulcrum of said pivotably mounted lever.

4. A bag-making apparatus in accordance with claim 3, wherein said attachment adjustment means further includes a gear drive on each of said attachments for effecting translation movement thereof on said attachment bed along said web flow path, the gear drive of each attachment being in driven engagement with the respective one of said gear racks on the attachment for effecting translational movement of the attachment.

5. A bag-making apparatus in accordance with claim 2, wherein said apparatus includes photoeye means fixedly positionable on said attachment bed for generating a signal in response to a registration mark provided on each bag being made, said pivotably mounted lever having a fulcrum fixed relative to said photoeye means.

6. A bag-making apparatus in accordance with claim 2, wherein said apparatus includes sealing means positioned downstream of said web draw drive mechanism, said pivotably mounted lever having a fulcrum fixed relative to said sealing means in vertical alignment therewith.

7. A bag-making apparatus in accordance with claim 6, wherein one of said movably mounted attachments comprises photoeye means for generating a signal in response to a registration mark provided on each bag being made.

8. A bag-making apparatus in accordance with claim 1, wherein said adjustment means includes a scanner for generating a signal corresponding to the relative position of a registration mark provided on each bag being made, said adjustment means further including control means operatively connecting said scanner to said actuator means for effecting operation of said actuator means responsively to the signal generated by said scanner.

9. A bag-making apparatus in accordance with claim 1, wherein said adjustment means includes a scanner for generating a signal corresponding to the relative position of a registration mark provided on each bag being made, said adjustment means further including control means operatively connecting said scanner to said actuator means for effecting operation of said actuator means responsively to the signal generated by said scanner.

10. A bag-making apparatus, comprising:

an attachment bed defining a web flow path along which a web of bags is moved;

a web draw drive mechanism for drawing said web along said attachment beg;

a plurality of bag-making attachments movably mounted on said attachment bed along said web flow path for respective operative association with bags being made; and adjustment means for adjustably positioning said attachments along said attachment bed for accommodating changes in print repeat length, wherein D corresponds to a first print repeat length, and Δ corresponds to a change in print repeat length, said adjustment means being configured to effect conjoint translational movement of said attachments on said attachment bed along said web flow path while positioning said attachments proportionately to each other.

11. A bag-making apparatus in accordance with claim 10, wherein said adjustment means includes a scanner for generating a signal corresponding to the relative position of a registration mark provided on each bag being made, said adjustment means further including means for driving each of said attachments along said attachment bed responsively to the signal generated by said scanner.

12. A bag-making apparatus in accordance with claim 11, wherein said drive means comprises at least one pivotably mounted lever extending generally along said web flow path for operative connection with each of said attachments, said drive means further including actuator means for pivoting said lever about a fulcrum to thereby effect driven conjoint movement of said attachments on said attachment bed.

13. A bag-making apparatus in accordance with claim 12, wherein said drive means further includes a plurality of gear racks respectively mounted on said attachments each in operative engagement with said pivotably mounted lever so that pivotal movement of said lever translates each of said gear racks proportionately to the spacing of each gear rack from the fulcrum of the lever.

14. A bag-making apparatus in accordance with claim 13, wherein said apparatus includes photoeye means fixedly positionable on said attachment bed for generating a signal in response to a registration mark provided on each bag being made, said povitably mounted lever having a fulcrum fixed relative to said photoeye means.

15. A bag-making apparatus in accordance with claim 13, wherein said apparatus includes sealing means positioned downstream of said web draw drive mechanism, said pivotably mounted lever having a fulcrum fixed relative to said sealing means in vertical adjustment therewith, one of said movably mounted attachments comprising photoeye means for generating a signal in response to a registration mark provided on each bag being made.

16. A bag-making apparatus in accordance with claim 10, wherein said adjustment means comprises servo motor drive means provided on each of said plurality of bag-making attachments.

17. A bag-making apparatus, comprising:

an attachment bed defining a web flow path along which a web of bag-making material is moved;

a web draw drive mechanism for drawing said web along said attachment bed;

a plurality of bag-making attachments mounted on said attachment bed along said web flow path for respective operative association with bags being made; and adjustment means for adjustably proportionately positioning said attachments relative to said web of material wherein said adjustment means comprises at least one pivotably mounted lever extending generally along said web flow path and actuator means for pivoting said lever.

18. A bag-making apparatus in accordance with claim 17, wherein said adjustment means comprises at least one S-wrap means operatively connected to said lever.

19. A bag-making apparatus, comprising:

an attachment bed defining a web flow path along which a web of bag-making material is moved;

a web draw drive mechanism for drawing said web along said attachment bed;

a plurality of bag-making attachments mounted on said attachment bed along said web flow path for respective operative association with bags being made; and adjustment means for adjustably proportionately positioning said attachments relative to said web of material wherein said adjustment means comprises servo drive means provided on each of said attachments to move said attachments relative to said attachment bed and control means for operating said servo drive means to proportionately position said attachments relative to said web of material.

* * * * *